US011807479B2

(12) United States Patent
Kobayashi et al.

(10) Patent No.: US 11,807,479 B2
(45) Date of Patent: Nov. 7, 2023

(54) DEVICE FOR CORRECTING MEANDERING IN NON-CONTACT CONVEYANCE FOR STRIP MATERIAL

(71) Applicant: JFE Steel Corporation, Tokyo (JP)

(72) Inventors: Hirokazu Kobayashi, Tokyo (JP); Yuichi Ohashi, Tokyo (JP); Yuhei Iwami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 293 days.

(21) Appl. No.: 17/286,961

(22) PCT Filed: Oct. 28, 2019

(86) PCT No.: PCT/JP2019/042113
§ 371 (c)(1),
(2) Date: Apr. 20, 2021

(87) PCT Pub. No.: WO2020/090707
PCT Pub. Date: May 7, 2020

(65) Prior Publication Data

US 2021/0387824 A1 Dec. 16, 2021

(30) Foreign Application Priority Data

Oct. 31, 2018 (JP) ..... 2018-205005

(51) Int. Cl.
*B65H 23/032* (2006.01)
*B65H 20/14* (2006.01)
*B65H 23/24* (2006.01)

(52) U.S. Cl.
CPC ..... *B65H 23/0324* (2013.01); *B65H 20/14* (2013.01); *B65H 23/24* (2013.01)

(58) Field of Classification Search
CPC ..... B65H 20/14; B65H 23/0324; B65H 23/24
See application file for complete search history.

(56) References Cited

U.S. PATENT DOCUMENTS 6,091,055 A 7/2000 Naka et al.

FOREIGN PATENT DOCUMENTS

JP 4411451 B 5/1969
JP 472901 B1 1/1972
(Continued)

OTHER PUBLICATIONS

Chinese Office Action with Search Report for Chinese Application No. 201980071438.X, dated Jun. 2, 2022, 9 pages.
(Continued)

*Primary Examiner* — William E Dondero
(74) *Attorney, Agent, or Firm* — RATNERPRESTIA

(57) ABSTRACT

Provided is a device for correcting meandering of a strip material capable of correcting meandering caused in the strip material and conducting stable conveyance even when the meandering amount is small. The device for correcting meandering in a non-contact conveyance of a strip material that supports and conveys the continuously travelling strip material at a non-contact state by floating the strip material using a group of one or more floaters arranged in series, is characterized in that a gas nozzle for jetting a gas to a lower surface of the strip material is disposed in at least one section between the most upstream floater among the floater group and a conveyance roll located immediately upstream of the floater, between adjacent two floaters and between the most downstream floater among the floater group and a conveyance roll located immediately downstream of the floater as a mechanism for imparting tilting to the strip material to operate the tilting of the strip material in the widthwise direction above the floater.

8 Claims, 2 Drawing Sheets

(56) References Cited

FOREIGN PATENT DOCUMENTS

| | | | |
|---|---|---|---|
| JP | 5239261 | A | 3/1977 |
| JP | 62158827 | A | 7/1987 |
| JP | 62235429 | A | 10/1987 |
| JP | 63216928 | A | 9/1988 |
| JP | 03104826 | A | 5/1991 |
| JP | 047249 | A | 1/1992 |
| JP | 06107360 | A | 4/1994 |
| JP | 11118357 | A | 4/1999 |
| JP | 2015131705 | A | 7/2015 |

OTHER PUBLICATIONS

Korean Office Action for Korean Application No. 10-2021-7012702, dated Oct. 26, 2022 with Concise Statement of Relevance of Office Action, 4 pages.

Japanese Office Action for Japanese Application No. 2020-509130, dated Apr. 13, 2021, with Concise Statement of Relevance of Office Action, 5 pages.

International Search Report and Written Opinion for International Application No. PCT/JP2019/042113, dated Jan. 21, 2020, 7 pages.

DEVICE FOR CORRECTING MEANDERING IN NON-CONTACT CONVEYANCE FOR STRIP MATERIAL

CROSS REFERENCE TO RELATED APPLICATIONS

This is the U.S. National Phase application of PCT/JP2019/042113, filed Oct. 28, 2019, which claims priority to Japanese Patent Application No. 2018-205005, filed Oct. 31, 2018, the disclosures of each of these applications being incorporated herein by reference in their entireties for all purposes.

FIELD OF THE INVENTION

This invention relates to a device for correcting meandering in non-contact conveyance of a strip material where a continuously travelling strip material is conveyed at a non-contact state with a conveyance roll while being floated by a group of one or more floaters.

BACKGROUND OF THE INVENTION

The production process of steel products includes various steps for subjecting a strip material such as cold-rolled steel strip to various process such as heat treatment, plating treatment, painting treatment and so on while keeping the strip material travel continuously. Such processes usually use "roll conveyance" in which the strip material is conveyed while being supported in contact with a roll as a means for the conveyance of the strip material.

However, conventional roll conveyance methods have problems that, for example, in a process in which a strip material such as cold-rolled steel strip is coated on its surface with various coatings, then dried and baked or a process in which a strip material is subjected to a heat treatment at a high temperature while travelling continuously, defects such as scratches, scraping and the like are easily caused on the material surface or on the coated film due to the contact between the strip material and the conveyance roll. As a method for solving such a problem, there has been developed a non-contact conveyance apparatus for conveying a strip material at a non-contact state with a conveyance roll by using a floater which can float the strip material by a gaseous pressure or the like.

Since the strip is floated in the non-contact conveyance apparatus that uses the floater, a friction force by the contact with a supporter is not caused. Accordingly, it is pointed out that the non-contact conveyance apparatus has such a problem in the sheet passing stability that the strip material slips laterally to cause meandering or the strip material is flapped by air draft or the like that is jetted to float the strip material. Therefore, many examinations have been made to prevent the floated strip material from meandering and flapping for stable conveyance of the strip material.

As a method for correcting the meandering, for example, Patent Literature 1 proposes a conveyance method of a strip material by using a floater that supports the strip material in a catenary form at a non-contact state by jetting gas, in which a side plate having a height higher than a usual conveyance level of the strip material is arranged outside each widthwise end portion of the strip material on the floater, whereby a meandering strip material can be conveyed without each widthwise end portion thereof coming in contact with the side plate. In the floater of Patent Literature 1, however, the height of the outermost side plate only in the widthwise direction of the strip material is made high, and hence driving force for returning the strip material to the center is not exerted unless the strip material largely meanders. Therefore, it is difficult to convey the strip material in the central part in the widthwise direction at a high accuracy when the meandering amount of the strip material is relatively small.

As a method for correcting a shifting force applied to the strip material, Patent Literature 2 discloses a method of disposing a gas jet nozzle for jetting a high-pressure gas from above or below an edge portion of the strip material above the floater to operate the tilting of the strip material.

As a method for forcibly exerting a correction force when the strip material is shifted from a center position, Patent Literature 3 discloses a method for correcting meandering by dividing the inside of the floater chamber to adjust a gas pressure in the widthwise direction.

PATENT LITERATURE

Patent Literature 1: JP-A-H06-107360
Patent Literature 2: JP-A-S63-216928
Patent Literature 3: JP-A-H04-7249

SUMMARY OF THE INVENTION

In the technique disclosed in Patent Literature 2, however, the gas jetting to directly above the floater or to the floater affects stable floating of the strip material above the floater, which is not preferable. In the technique disclosed in Patent Literature 3, the configuration of the floater becomes complicated to cause a disadvantage that the introduction cost increases, and also the stable floating of the strip material above the floater may be badly affected by changing the pressure distribution in the widthwise direction to correct meandering.

The invention is made in consideration of the above problems inherent to the conventional techniques, and an object thereof is to provide a device for correcting meandering of a strip material in a non-contact conveyance apparatus that floats and conveys a strip material at a non-contact state by jetting gas or the like, in which, even when the meandering amount of the strip material is small, the meandering of the strip material can be corrected to perform stable conveyance without adversely affecting the surface of the strip material.

The inventors have made various studies to solve the above task. Consequently, it has been found out that, when a continuously travelling strip material is conveyed while being floated by a floater group comprising one or more floaters, meandering of the strip material can be controlled with a high accuracy even when the meandering amount is small, by forcibly changing a height position in the widthwise direction of the strip material so that the strip material tilts in at least one section between the most upstream floater in the floater group and a conveyance roll located immediately upstream of the floater, between two adjacent floaters, and between the most downstream floater in the floater group and a conveyance roll located immediately downstream of the floater, and thus, the invention has been accomplished.

That is, the invention according to exemplary embodiments provides a device for correcting meandering in a non-contact conveyance of a strip material that supports and conveys a continuously travelling strip material at a non-contact state by floating the strip material with a group of one or more floaters arranged in series, in which a gas nozzle for jetting gas to a lower surface of the strip material is disposed as a mechanism for imparting tilting to the strip material to operate tilting of the strip material in the widthwise direction above the floater, in at least one section between the most upstream floater among the floater group and a conveyance roll located immediately upstream of the floater, between two adjacent floaters, and between the most downstream floater among the floater group and a conveyance roll located immediately downstream of the floater.

In the device for correcting meandering of a strip material according to the invention, it is preferable to dispose the gas nozzle at a position within S/2 from the floater, where S is defined as a center distance between the most upstream floater among the floater group and the conveyance roll located immediately upstream of the floater, a center distance between the adjacent two floaters and a center distance between the most downstream floater among the floater group and the conveyance roll located immediately downstream of the floater.

In the device for correcting meandering of a strip material according to the invention, it is preferable to dispose the gas nozzle at a position lower than the height position of the strip material before the gas jetting by not less than H, where H is defined as an average floating amount of the strip material above the floater.

In the device for correcting meandering of a strip material according to the invention, it is preferable to adjust the gas pressure jetted from the gas nozzle in proportion to the total tension of the strip material.

According to an embodiment of the invention, in an apparatus for conveying a continuously travelling strip material at a non-contact state with a conveyance roll while floating the strip material with a floater, gas is jetted from the nozzle, which is disposed at a position below the strip material and other than the floater floating the strip material, to forcibly tilt the strip material, whereby the meandering of the strip material is corrected, and hence the strip material can be returned to the center position in the widthwise direction even in the meandering of a slight amount to stably convey the strip material.

DETAILED DESCRIPTION OF EMBODIMENTS OF THE INVENTION

Figure 1:
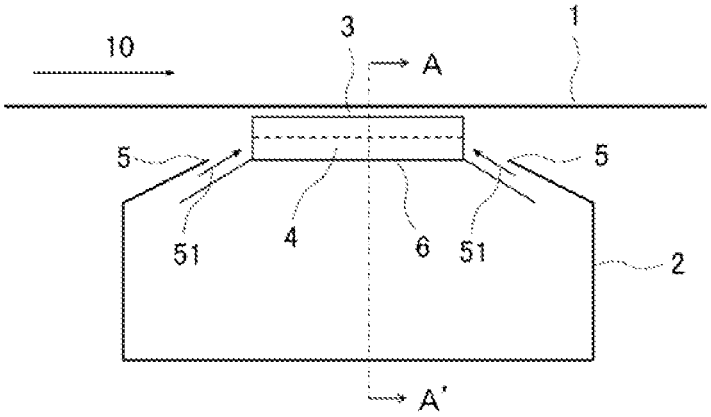
FIG. 1 is a side view of a floater 2 used in a non-contact conveyance of a strip material 1.

FIG. 1 is a side view of a floater 2, as an example usable in embodiments of the invention, that conveys a continuously travelling strip material 1 at a floating state. The floater 2 conveys the strip material 1 at a floating state by jetting gas from below the strip material 1 to the lower surface of the strip material 1. Concretely, the floater 2 is arranged below the travelling strip material 1, and gas is supplied from a fan, blower and the like which are not shown into the floater 2 to render the pressure inside the floater higher than atmospheric pressure. The high-pressure gas in the floater 2 is jetted to the lower surface of the strip material from a slit-like gas jetting port (slit nozzle) 5 arranged at the upper portion of the floater 2 along the widthwise direction 11 of the strip material. The slit nozzle 5 is arranged at two positions in the travelling direction 10 of the strip material, and each gas jetting directions 51 is opposed to each other. Therefore, the gas jetted from the slit nozzle 5 is confined in a space between the strip material 1 and a top board 6 located at the top of the floater 6 to generate static pressure, which supports the strip material 1 at a floating state.

Figure 2:
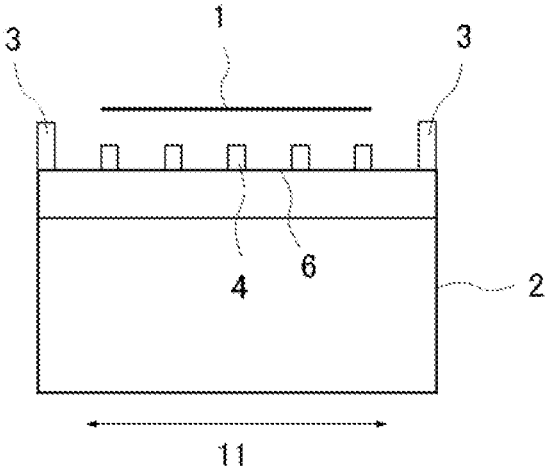
FIG. 2 is a section view of the floater 2 used in the non-contact conveyance of the strip material 1 viewing from a line A-A'.

FIG. 2 shows a section of the floater 2 shown in FIG. 1 viewing from a line A-A'. A plurality of rib plates 4 are stood on the top board 6 in the upper portion of the floater 2 at intervals in the widthwise direction 11 of the strip material. The rib plates 4 prevent the gas jetted from the slit nozzle 5 from flowing out in the widthwise direction 11 of the strip material, whereby static pressure can be stably generated between the strip material 1 and the top board 6 to allow the strip material 1 to float up stably. From a viewpoint of preventing the gas jetted from the slit nozzle 5 from flowing out toward the travelling direction 10 of the strip material, a plurality of rib plates may be stood in the travelling direction 10 of the strip material, in addition to the rib plates 4. Moreover, side plates 3 having a height higher than that of the rib plate 4 are stood on both outer sides of the rib plate 4, i.e., both widthwise ends of the top board 6 in the widthwise direction 11 of the strip material to prevent the meandering of the strip material.

Figure 3:
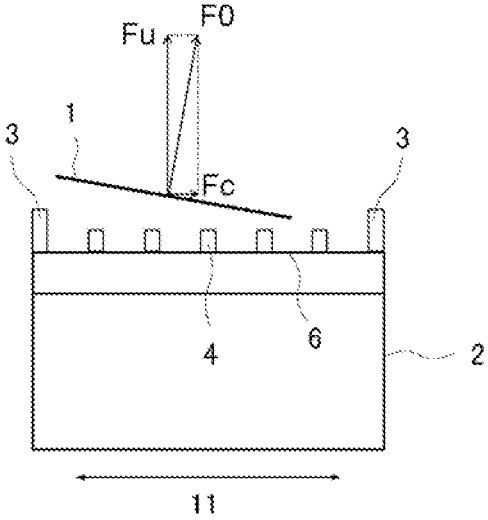
FIG. 3 PRIOR ART
FIG. 3 is a schematic view showing a meandering correction theory of the floater 2 in a conventional technique.

Here, the meandering correction capability of the floater 2, shown in FIGS. 1 and 2, for the strip material will be described using FIG. 3. When the strip material 1 meanders to one side (left side in FIG. 3), a gas flow path between the side plate 3 on the meandered side and the strip material 1 becomes narrower, and hence static pressure FO generated on the lower surface of the strip material 1 becomes higher. Therefore, the floating amount of the strip material 1 on the meandering side becomes larger and the strip material 1 comes into a tilting state as shown in FIG. 3. The static pressure FO applied to the lower surface of the strip material 1 acts as a force in a direction vertical to the surface of the strip material. This force can be divided into two vectors of a vertical direction force and a horizontal direction force. The vertical direction force is a floating force Fu that supports the own weight of the strip material 1, and the horizontal direction force acts as a correction force Fc for correcting the meandering of the strip material 1. That is, the tilting of the strip material 1 above the floater generates ae horizontal component force of the static pressure applied to the lower surface, which works as a force to correct the meandering. Consequently, the strip material 1 can be conveyed on the floater without continuing to meander.

However, the end portion of the strip material 1 needs to sufficiently approach to the side plate 3 in order that the correction force Fc correcting the meandering acts, which requires a certain amount meandering to be generated. In other words, the conventional floater 2 is effective in large meandering, but hardly causes the meandering correction force Fc in small meandering.

The inventors have studied the meandering correction method that is effective even in the small meandering. As a result, referring the above meandering correction capability of the floater as a clue, they have conceived that forcibly tilting the strip material 1 allows the meandering correction force Fc to be generated even in small meandering, and the invention has been accomplished. Concretely, the present invention according to exemplary embodiments is a method for correcting meandering comprising:

disposing a nozzle for jetting gas to a lower surface of the strip material of the upstream side or downstream side of the floater 2, making difference in rotation moment centered on the widthwise center of the strip material between the right and left sides in the widthwise direction 11 of the strip material to cause the strip material to tilt by adjusting the nozzle position and gas pressure, and controlling the tilting of the strip material above the floater to thereby exert meandering correction force Fc by a fluid force (static pressure) of the floater.

Figure 4:
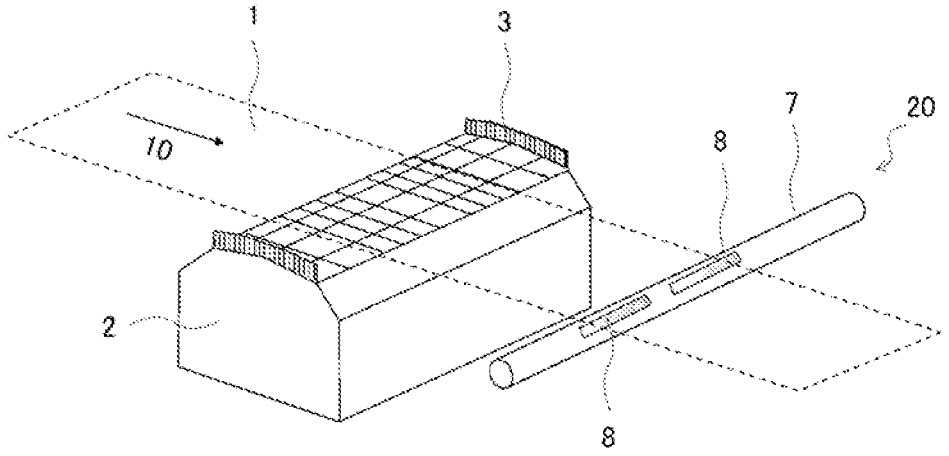
FIG. 4 is a schematic view showing a device for correcting meandering 20 using a gas nozzle 7 according to an embodiment of the invention.

In an embodiment of the invention, a device for correcting meandering 20 is configured by arranging a meandering correction gas nozzle 7 for tilting the strip material 1 at a position below the strip material in the vicinity of the floater 2 as shown in FIG. 4. As being a non-contact type different from a method of tilting a strip material by pushing the roll or the like, the invention has an advantage that damage due to the contact is not caused in the strip material. It is preferable to dispose two or more meandering correction gas nozzles 7 on both sides of the strip material in the widthwise direction 11 so that the strip material can tilt no matter which side the strip material meanders. In order to tilt the strip material 1, rotation moment centered on the widthwise center of the strip material can be exerted by making a difference in the gas pressure jetted from the meandering correction gas nozzle 7 between the both sides of the strip material in the widthwise direction 11. In this case, it is possible to correct meandering by making the pressure on the side where the strip material meanders higher.

Figure 5:
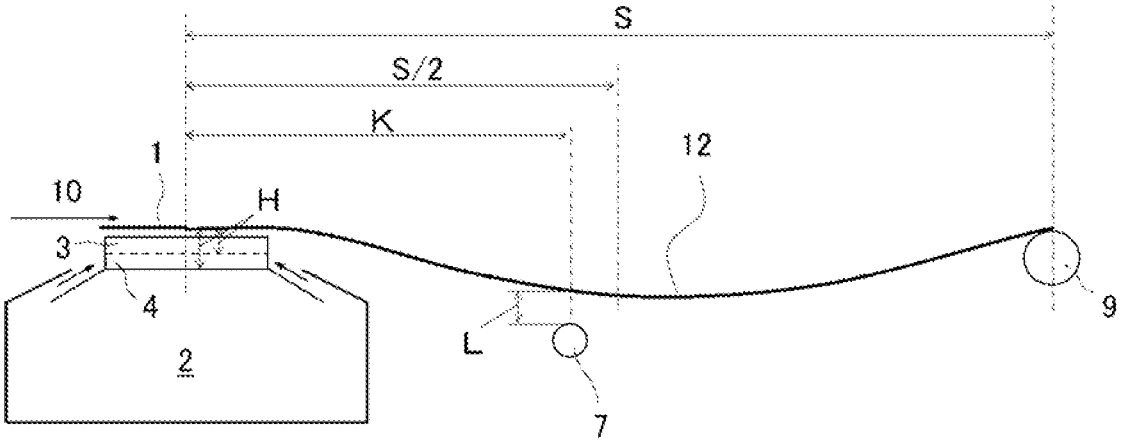
FIG. 5 is a schematic view showing an arrangement distance K and a nozzle distance L of the gas nozzle 7, an average floating amount H of the strip material 1 according to an embodiment of the invention.

In order to exert the meandering correction force Fc more effectively, it is preferable to dispose the meandering correction gas nozzle 7 close to the floater 2 so that the tilting of the strip material above the floater 2 can be largely changed by the gas jetting with high responsivity. As shown in FIG. 5, the arrangement position of the meandering correction gas nozzle 7 (arrangement distance K of the meandering correction gas nozzle 7 from the center of the floater) is preferable to be within S/2 in the longitudinal direction of the strip material, where S is defined as a center distance between the most upstream floater 2 among the floater 2 group and a conveyance roll 9 located immediately upstream of the floater 2, a center distance between the adjacent two floaters 2 and a center distance between the most downstream floater 2 among the floaters 2 group and a conveyance roll 9 located immediately downstream of the floater 2. That is, it is preferable to arrange the meandering correction gas nozzle 7 such that the gas can be jetted to the strip material within a range up to the lowest point of a catenary curve (catenary) formed by the strip material between the floater and an upstream floater or a downstream floater or between the floater and the conveyance roll. When the gas jetting position to the strip material is farther than the above position from the floater, the effect of tilting the strip material above the floater and the responsivity become insufficient. As to the lower limit of the gas jetting position, when the gas jetting position is too close to the floater, the gas flow from the floater nozzle is changed by the gas additionally jetted from the meandering correction gas nozzle, which affects the static pressure for stably floating the strip material above the floater. Accordingly, it is preferable to separate the jetting gas position from the end of the floater in the longitudinal direction of the strip material. It is more preferable to separate the nozzle from the end of the floater by not less than 100 mm. Moreover, FIG. 5 shows an example when the center distance between the most downstream floater and the conveyance roll located immediately downstream of the floater is S.

It is preferable to adjust the gas pressure of the meandering correction gas nozzle 7 to 0 (no gas jetting) or within the range of not less than 0.1 P but not more than 10 P, where P is defined as the pressure of the floater. This is due to the fact that when the pressure is too high, the behavior of the strip material is rapidly changed to cause the sheet to pass unstably and also the floater is tilted by a force which is larger than the floating force (static pressure) above the floater 2 and hence the floater 2 has a high possibility of coming in contact with the strip material 1. When the pressure is too low, on the other hand, it is necessary to increase the opening area of the meandering correction gas nozzle in order to impart tilting to the strip material, resulting in poor response. Also, it is preferable to increase the gas pressure of the meandering correction gas nozzle in proportion to the total tension of the strip material. As the tension of the strip material becomes higher, the strip material is more unlikely be tilted, and hence it is preferable to increase the gas pressure of the meandering correction gas nozzle. In order to maintain the corresponding tilting capability of the strip material when the tension is changed, therefore, it is preferable to also change the gas pressure in proportion to the total tension of the strip material.

A distance L between the position 12 of the strip material when the meandering correction gas nozzle is not used and the upper end of the meandering correction gas nozzle is preferable to be not less than H downward, where H is defined as an average floating amount of the strip material above the floater. As vertical vibration is caused in the strip material due to the floating by the gas, the strip material is more likely to come in contact with the nozzle, when the position of the meandering correction gas nozzle is higher than the above position 12. As to the upper limit of the distance L for separating the meandering correction gas nozzle from the strip material, it is preferable to arrange the top of the meandering correction gas nozzle within 20 D, where D is defined as the nozzle diameter or a slit width when slit nozzle is used. When the meandering correction gas nozzle is arranged separated from the strip material farther than the above maximum position, it is difficult to impart tilting to the strip material with high responsivity, influenced by the attenuation of the gas jetting stream. Therefore, the distance L between the meandering correction gas nozzle and the strip material is preferably within the range of H to 20 D, more preferably 1.5H to 15 D. The average floating amount H is defined as the average value of the distance from the top of the rib plate to the strip material over full width of the strip material when the rib plate is used, as also shown in FIG. 5, and as the average value of the distance from the top board of the floater to the strip material over full width of the strip material when the rib plate is not used.

In order to prevent the opening of the meandering correction gas nozzle from displaced out of the surface of the strip material due to the change in the width or meandering of the strip material, the opening of the meandering correction gas nozzle is preferable to have a long-slit-like shape in the widthwise direction of the strip material. Here, the slit-like shape includes such a shape that a plurality of nozzles are densely arranged in the widthwise direction of the strip material.

The tilting angle α of the strip material 1 above the floater 2 by jetting the gas from the meandering correction gas nozzle 7 is preferable to fall within the range of ±0.3 to 6° with respect to the horizontal face, although it depends on the width of the strip material and the floating amount. When the absolute value of the tilting angle α is less than 0.3°, the tilting amount of the strip material is too small to generate sufficient meandering correction force. On the other hand, when the absolute value of the tilting angle α exceeds 6°, it is necessary to float the strip material higher above the floater, which deteriorates the sheet passing stability. More preferably, the tilting angle α of the strip material above the floater falls within the range of ±0.5 to 5°.

The meandering correction gas nozzle 7 is preferable to have a mechanism for evacuating and separating from the strip material 1, in preparation for a case that the meandering correction function is not used. A method of adjusting the distance between the meandering correction gas nozzle 7 and the strip material 1 can use electromotive cylinder, hydraulically operated cylinder and the like.

Since no friction force (binding force in widthwise direction) acts on the strip material, the meandering speed in the conveyance apparatus that floats the strip material by the floater or the like is very fast, and hence it is necessary to control the generated meandering with high responsivity. To this end, it is preferable to measure the meandering amount at the exit side of the conveyance apparatus (floater groups) and feedback the measurement value to control the gas pressure of the meandering correction gas nozzle 7. Also, it is also effective to use a method of measuring the form of the strip material at a stage before the conveyance apparatus to predict a tendency of meandering amount and feedforward the predicted result to control the gas pressure of the meandering correction gas nozzle 7.

The material of the meandering correction gas nozzle is not particularly limited, but is preferably a material that can withstand the high-temperature environment and corrosive environment in an annealing furnace or a drying furnace. The material can preferably use ceramics, steel, stainless steel (SUS) and so on. Also, the top of the meandering correction gas nozzle is preferable to be equipped with a guard capable of suppressing damage of the nozzle when coming in contact with the strip material. The material of the guard can preferably use ceramics, steel, stainless steel (SUS) and so on that can withstand the high-temperature environment and corrosive environment.

One or more blowers feeding gas to the meandering correction gas nozzle may be used. In the meandering correction and control, gas is repeatedly fed and stopped to the plural meandering correction gas nozzles, so that it is preferable to have a switching valve to allow switching of which nozzle to supply or stop gas. A large-capacity blower is difficult to switch from jetting to stopping the gas instantly, so that it is preferable to equip an escape port, which can jet the gas to an area where the strip material is not affected by the jetted gas, with at least in one switching valve system. Thus, by escaping the gas without stopping the blower, it becomes possible to jet and stop the gas repeatedly with high responsivity from the meandering correction gas nozzle by the switching valve.

EXAMPLES

In a drying furnace provided with a non-contact conveyance apparatus where 5 floater devices shown in FIGS. 1 and 2 are arranged in series at an interval of 10 m as a center-to-center distance, an experiment is conducted to heat and dry a strip steel sheet material having a width of 1200 m and a thickness of 0.3 mm at a non-contact state by passing the steel sheet under conveyance conditions shown in Table 1. The steel strip having a good shape with an elongation difference rate in the widthwise direction of less than 0.005% is meandered from a non-meandering state by 20 mm, using a meandering correction gas nozzle for imparting tilting as shown in FIGS. 4 and 5 to evaluate a time required for returning to the center (meandering response time (meandering correction capacity)) and occurrence of scratches.

The center distance between the most upstream floater and the conveyance roll located immediately upstream thereof and a center distance between the most downstream floater and a conveyance roll located immediately downstream thereof in the above conveyance apparatus are both 10 m. The meandering correction gas nozzle is arranged at an exit side of the fifth floater viewed from an entrance side of the strip material.

The meandering correction gas nozzle are provided with two slit-like shaped openings of 10 mm×600 mm at both sides of the strip material in the widthwise direction. Each opening is arranged so that one end of the 600 mm-length side is 50 mm displaced from the center of the strip material in the widthwise direction and the other end thereof is 50 mm displaced outward from the end of the strip material. The gas pressure of the meandering correction gas nozzle is adjusted within the range of 0 to 10 kPa as a gauge pressure.

Side plates having a height of 50 mm are arranged at an interval of 1500 mm in the widthwise direction in the floater. The floater has a nozzle interval in the longitudinal direction of the strip material of 1100 mm, and a length in the travelling direction of the strip material of 1500 mm, and a length in the widthwise direction of the strip material of 1500 mm. A slit width in the opening of the nozzle is 20 mm. A tension of the strip material in the conveyance is 0.6 kg/mm$^2$, and a conveying speed of the strip material is 100 m/min. Also, the inner pressure of the floater is about 0.6 kPa as a gauge pressure, and a floating height H of the strip material is 25 mm on average. The floating height is a distance from the top of the rib plate (top board when the rib plate is not used) to the average height position in the widthwise direction of the strip material.

TABLE 1

| No. | Gas nozzle arrangement distance K (mm) | Distance L between nozzle and strip material (mm) | Gas pressure (gauge pressure) P (kPa) | Meandering response time (s) | Presence or absence of scratches | Remarks |
|---|---|---|---|---|---|---|
| 1 | 1500 | 25 | 1 | 8 | Absence | Invention Example |
| 2 | 1500 | 50 | 2 | 9 | Absence | Invention Example |
| 3 | 1500 | 50 | 3 | 8 | Absence | Invention Example |
| 4 | 1500 | 50 | 0.5 | 10 | Absence | Invention Example |
| 5 | 3000 | 50 | 1 | 13 | Absence | Invention Example |

TABLE 1-continued

| No. | Gas nozzle arrangement distance K (mm) | Distance L between nozzle and strip material (mm) | Gas pressure (gauge pressure) P (kPa) | Meandering response time (s) | Presence or absence of scratches | Remarks |
|---|---|---|---|---|---|---|
| 6 | 3000 | 50 | 2 | 12 | Absence | Invention Example |
| 7 | 5000 | 50 | 2 | 17 | Absence | Invention Example |
| 8 | 5000 | 50 | 3 | 15 | Absence | Invention Example |
| 9 | 6000 | 50 | 2 | 105 | Absence | Invention Example |
| 10 | 3000 | 20 | 2 | 13 | Presence (slight) | Invention Example |
| 11 | 3000 | 15 | 2 | 14 | Presence | Invention Example |
| 12 | 1500 | 150 | 1 | 9 | Absence | Invention Example |
| 13 | 1500 | 200 | 1 | 10 | Absence | Invention Example |
| 14 | 1500 | 250 | 1 | 38 | Absence | Invention Example |
| 15 | 1500 | 50 | 6 | 11 | Absence | Invention Example |
| 16 | 1500 | 50 | 8 | 10 | Presence (slight) | Invention Example |
| 17 | 1500 | 50 | 10 | 9 | Presence | Invention Example |
| 18 | 850 | 50 | 1 | 9 | Absence | Invention Example |
| 19 | — | — | — | uncontrollable | Absence | Comparative Example |

In the above experiment, it is possible to conduct such a control that the strip material passing through the center is forcibly meandered and again returned to the center by changing the gas pressure of the meandering correction gas nozzle at a non-meandering state (meandering amount: 0 mm). Although a comparative example is conducted under a condition where no meandering correction gas nozzle is used, it is not possible to forcibly meander the strip material (exert the meandering correction force) passing through the center.

Although the meandering can be controlled even when the distance K from the center of the floater to the gas nozzle, the distance L from the strip material to the top of the nozzle and the gas pressure P of the nozzle are out of the preferable ranges, the meandering response time becomes longer or the occurrence of scratches is observed.

The meandering amount is measured by detecting the edge of the strip material using a two-dimensional laser sensor in the vicinity of the first conveyance roll after the drying furnace. The scratches are visually detected at the exit side of the drying furnace under a sufficiently bright fluorescent lamp.

The technique of the invention is not limited to the strip steel sheet material described in the above example and can be applied to strip metal sheets such as aluminum sheet, copper sheet and so on and strip material such as plastic film, paper and so on.

REFERENCE SIGNS LIST

1 strip material
2 floater
3 side plate
4 rib plate
5 gas jetting port (slit nozzle)
51 gas jetting direction
6 top board of floater
7 meandering correction gas nozzle
8 opening of meandering correction gas nozzle
9 conveyance roll
10 travelling direction of strip material
11 widthwise direction of strip material
12 position of strip material when meandering correction gas nozzle is not used
20 device for correcting meandering
FO static pressure applied to lower surface of strip material
Fu floating force
Fc meandering correction force

The invention claimed is:

1. A device for correcting meandering in a non-contact conveyance of a strip material that supports and conveys a continuously travelling strip material at a non-contact state by floating the strip material with a group of one or more floaters arranged in series below the strip material, characterized in that two or more gas nozzles for jetting gas to a lower surface of the strip material are disposed on both sides of the strip material in the widthwise direction, as a mechanism for imparting tilting to the strip material to operate tilting of the strip material in the widthwise direction above the floater, irrespective of which side the strip material meanders, at least in one section between the most upstream floater among the floater group and a conveyance roll located immediately upstream of the most upstream floater, between two adjacent floaters, and between the most downstream floater among the floater group and a conveyance roll located immediately downstream of the most downstream floater, wherein a gas pressure jetted from each of the two or more gas nozzles is different between the two sides of the strip material in the widthwise direction.

2. The device for correcting meandering of a strip material according to claim 1, wherein the gas nozzle is disposed at a position within S/2 from the floater, where S is defined as a center distance between the most upstream floater among the floater group and the conveyance roll located immediately upstream of the floater, a center distance between the adjacent two floaters, and a center distance between the most downstream floater among the floater group and the conveyance roll located immediately downstream of the floater.

3. The device for correcting meandering of a strip material according to claim 2, wherein the gas nozzle is disposed at a position lower than the height position of the strip material before the gas jetting by not less than H, where H is defined as an average floating amount of the strip material above the floater.

4. The device for correcting meandering of a strip material according to claim 3, wherein the gas pressure jetted from the gas nozzle is controlled in proportion to the total tension of the strip material.

5. The device for correcting meandering of a strip material according to claim 2, wherein the gas pressure jetted from the gas nozzle is controlled in proportion to the total tension of the strip material.

6. The device for correcting meandering of a strip material according to claim 1, wherein the gas nozzle is disposed at a position lower than the height position of the strip material before the gas jetting by not less than H, where H is defined as an average floating amount of the strip material above the floater.

7. The device for correcting meandering of a strip material according to claim 6, wherein the gas pressure jetted from the gas nozzle is controlled in proportion to the total tension of the strip material.

8. The device for correcting meandering of a strip material according to claim 1, wherein the gas pressure jetted from the gas nozzle is controlled in proportion to the total tension of the strip material.

* * * * *